US005782301A

United States Patent [19]

Neuroth et al.

[11] Patent Number: 5,782,301

[45] Date of Patent: Jul. 21, 1998

[54] OIL WELL HEATER CABLE

[75] Inventors: David H. Neuroth, Tulsa; Larry V. Dalrymple; Robert Bailey, both of Claremore, all of Okla.

[73] Assignee: Baker Hughes Incorporated, Houston, Tex.

[21] Appl. No.: 728,319

[22] Filed: Oct. 9, 1996

[51] Int. Cl.[6] ..... E21B 36/04; H05B 3/56

[52] U.S. Cl. ..... 166/302; 166/60; 219/541

[58] Field of Search ..... 166/302, 60, 385, 166/65.1; 219/541, 544, 552

[56] References Cited

U.S. PATENT DOCUMENTS

| | | | |
|---|---|---|---|
| 3,831,636 | 8/1974 | Bittner | 138/173 |
| 4,100,673 | 7/1978 | Leavines | 29/611 |
| 4,152,577 | 5/1979 | Leavines . | |
| 4,454,378 | 6/1984 | Neuroth | 174/103 |
| 4,490,577 | 12/1984 | Neuroth | 174/103 |
| 4,570,715 | 2/1986 | Van Meurs et al. . | |
| 4,572,299 | 2/1986 | Vanegmond et al. . | |
| 4,585,066 | 4/1986 | Moore et al. . | |
| 4,626,665 | 12/1986 | Fort, III | 219/534 |
| 4,704,514 | 11/1987 | Van Egmond et al. . | |
| 4,707,568 | 11/1987 | Hoffman et al. . | |
| 5,060,287 | 10/1991 | Van Egmond . | |
| 5,414,217 | 5/1995 | Neuroth et al. . | |

FOREIGN PATENT DOCUMENTS

| | | |
|---|---|---|
| 816835C | 10/1951 | Germany . |
| WO 9427300A | 11/1994 | WIPO . |

OTHER PUBLICATIONS

Cable Armor Configurations, by Centrilift, (Consisting of 7 brochure sheets).

Petrotrace, (brochure consisting of 12 sheets).

*Primary Examiner*—Frank Tsay

*Attorney, Agent, or Firm*—James E. Bradley

[57] ABSTRACT

A heater cable is strapped alongside tubing in a well to heat the production fluids flowing through the tubing. The heater cable has three copper conductors surrounded by a thin electrical insulation layer. An extrusion of lead forms a protective layer over the insulation layers. The lead sheaths have flat sides which abut each other to increase heat transfer. A metal armor is wrapped around the lead sheaths of the three conductors in metal-to-metal contact. Three phase power is supplied to the conductors, causing heat to be generated which transmits through the lead sheaths and armor to the tubing.

20 Claims, 1 Drawing Sheet

OIL WELL HEATER CABLE

TECHNICAL FIELD

This invention relates in general to electrical cable and in particular to cable for transferring heat to oil well tubing.

BACKGROUND ART

This invention provides a method and apparatus for heating wellbores in cold climates through the use of an improved electrical heater cable. More particularly, but not by way of limitation, this invention relates to a method and apparatus for placing within a wellbore an electrical cable along the production tubing for maintaining adequate temperatures within the wellbore to maintain adequate flow characteristics of hydrocarbons running from a reservoir to the surface.

The production of oil and gas reserves has taken the industry to increasingly remote inland and offshore locations where hydrocarbon production in extremely cold climates is often required. Unique problems are encountered in producing oil in very cold conditions. As a result, production techniques in these remote and extreme climates require creative solutions to problems not usually encountered in traditionally warmer areas.

One problem often encountered in cold climate hydrocarbon production has been finding ways to maintain adequate hydrocarbon flow characteristics in the production tubing. For example, under arctic conditions, a deep permafrost layer surrounds the upper section of a wellbore. This cold permafrost layer cools the hydrocarbon production fluid as it moves up the production tubing, causing hydrates to crystallize out of solution and attach themselves to the inside of the tubing. Paraffin and asphaltene can also deposit on the inside of the tubing in like manner. As a result, the cross-section of the tubing is reduced in many portions of the upper section of the wellbore, thereby restricting and/or choking off production flow from the well. Also, if water is present in the production stream and production is stopped for any reason such as a power failure, it can freeze in place and block off the production tubing.

Wellbores having electrical submersible pumps experience higher production pressures due to the above restrictions, which accelerates wear of the pump and reduces the run life of the system, causing production costs to increase. Wells without downhole production equipment also suffer from similar difficulties as production rates fall due to deposition buildup. One method of overcoming these problems is to place a heating device of some sort adjacent to the production tubing to mitigate fluid temperature loss through the cold section of the well.

Presently, conventional heating of the production tubing utilizes a specialized electrical heat trace cable incorporating a conductive polymer which is attached to the tubing. This polymer heat trace cable is designed to be temperature sensitive with respect to resistance. The temperature sensitive polymer encapsulates two electrical conductors, and as the electrical current flows through the polymer between the conductors it causes resistance heating within the polymer, which in turn raises its temperature. As the temperature increases, the resistance of the polymer increases and the system becomes self regulating. However, this conventional approach to making a heater cable for application in oil wells has several severe limitations.

One primary disadvantage of heat trace cable with conductive polymers is that these polymers can easily be degraded in the hostile environment of an oil well. To overcome this, several layers of expensive high temperature protective layers have to be extruded over the heat trace cable core. This increases the cost substantially and makes the cables very difficult to splice and repair. Another disadvantage of heat trace cables of conventional conductive polymer design is that the length of the cables is limited due to the decrease in voltage on the conductors along the length. This requires extra conductors to be run along the heat trace cable to power additional sections of heat trace cable deeper in the well. These extra conductors also require extra protection with appropriate coverings, and they require extra splices along the cable assembly. Splices also reduce reliability of the system and the coverings add even more cost.

Conventional electrical submersible pumps use a three-phase power cable which has electrical insulated conductors embedded within an elastomeric jacket and wrapped in an outer armor. The insulation is fairly thick, being typically in the range from 0.070 to 0.090 inch. One type, for hydrogen sulfide protection employs extruded lead sheaths around the insulated conductors. An elastomeric braid, tape or jacket separates the lead sheaths from the outer armor. These cables are used only for power transmission, and would not transmit heat efficiently to tubing because of the thick layer of insulation, and because of the tape, braid, or jacket.

Therefore, there is a need for a method and cable for heating production tubing in a reliable manner without requiring expensive multi-layer protective coverings and extra splices. In addition, this new cable should be robust enough to be reused and be cost effective in its construction and design.

DISCLOSURE OF INVENTION

The present invention provides a new and improved heater cable and methods for applying the heater cable in subsurface oil well applications. A heater cable with heat generating conductors is disclosed wherein the conductors are surrounded by a thin high-temperature dielectric insulating material and are electrically joined together at the end furthest from the power source. The conductors are preferably made of copper or of other low resistance conducting metal. A protective sheathing encapsulates the dielectric material. The protective sheathing is advantageously made of lead. The cable may be made in a flat or round configuration and is completed by armoring the conductor assembly with an overall wrap of steel tape providing extra physical protection.

The heater cable may also optionally include thermocouples and/or other sensors to monitor temperature of the heater cable and/or other characteristics of the surrounding environment. For example, temperature at various points along the length of the cable may be monitored and relayed to a microprocessor so as to adjust the power source to the heater cable. Other instruments also may be connected to the far end of the heater cable to use the heater cable as a transmission means to carry additional well performance data to a microprocessor.

In the preferred embodiment, a three-phase copper conductor heater cable is disclosed. The low-resistance heater cable may have more than one conductor size along its length to vary the amount of heat dissipated by the cable in various sections of the well.

The heater cable in one major application is inserted in a hydrocarbon wellbore and strapped to a production tubing contained therein. The heater cable is provided in the wellbore to deliver heat along the tubing in the wellbore, thereby preventing build-up of hydrates, ice, asphaltenes and paraffin wax or other heat sensitive substances which may collect on the inner surface of the production tubing, causing a restriction or obstruction to production fluid flow.

DETAILED DESCRIPTION OF THE INVENTION

Figure 1:
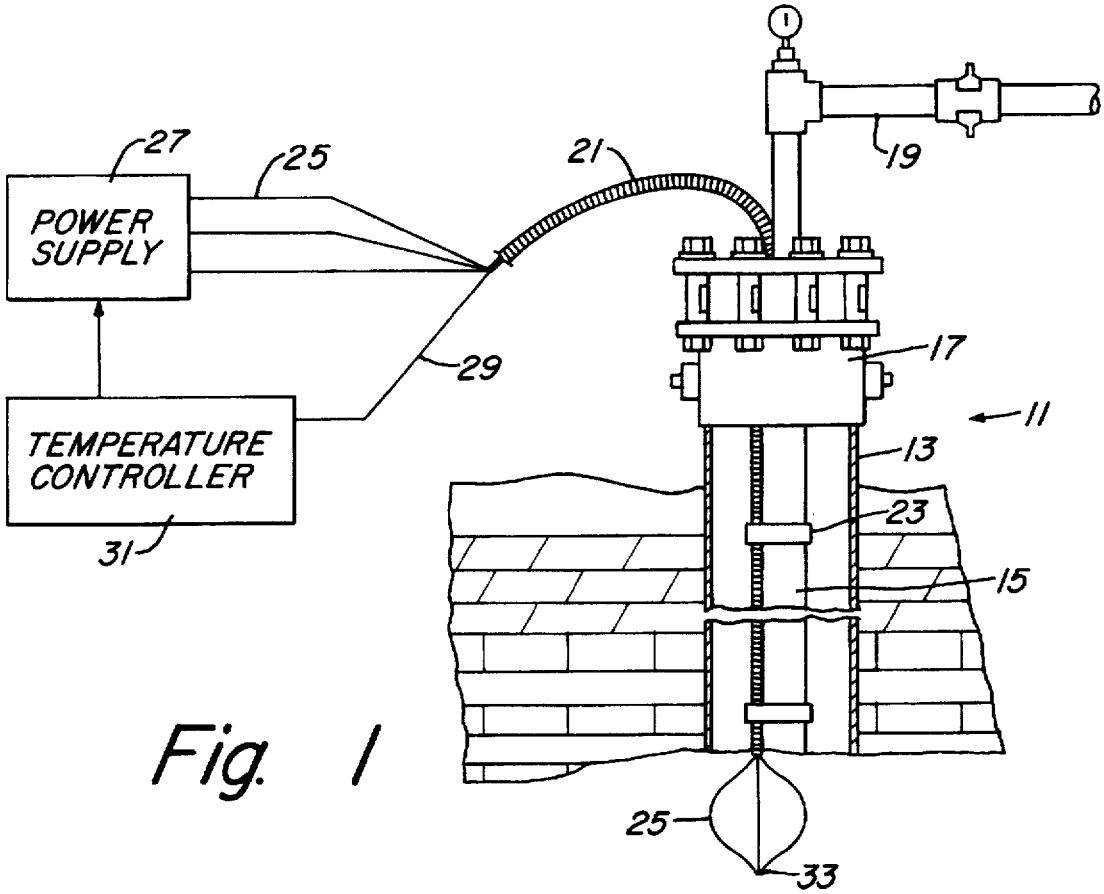
FIG. 1 is a schematic sectional view illustrating a well having a heater cable in accordance with this invention.

FIG. 1 illustrates a well 11 having one or more strings of casing 13 extending through the well. A string of production tubing 15 extends through casing 13 to the surface. A wellhead 17 is located at the surface. A flowline 19 extends from wellhead 17 for the transmission of production fluids.

A heater cable 21 extends through wellhead 17 and down the well along tubing 15. Straps 23 secure heater cable 21 to tubing 15 at regular intervals. Heater cable 21 has three conductors 25 which are of a metal which is a good electrical conductor. In one embodiment, conductors 25 are #6 AWG copper. The three conductors 25 are electrically insulated from each other and are connected at the surface to a power source 27, which supplies three-phase electrical current down conductors 25. In the preferred embodiment, power source 27 is a conventional supply which supplies current at levels which can be varied. The voltage supplied may be in the range from about 150 to 500 volts, considerably lower than voltage supplied by a power supply for an electrical submersible pump, which may be 1000 to 2000 volts.

Optionally, a sensing wire 29 extends along the length of heater cable 21 to a downhole transducer or sensor (not shown). Sensing wire 29 comprises in the embodiment shown a two conductor cable that leads to a temperature controller 31. Temperature controller 31 is preferably a microprocessor which controls power source 27 for regulating the amount of power supplied through conductors 25. As shown schematically in FIG. 1, the lower ends of conductors 25 are directly connected together at a common junction 33.

Figure 2:
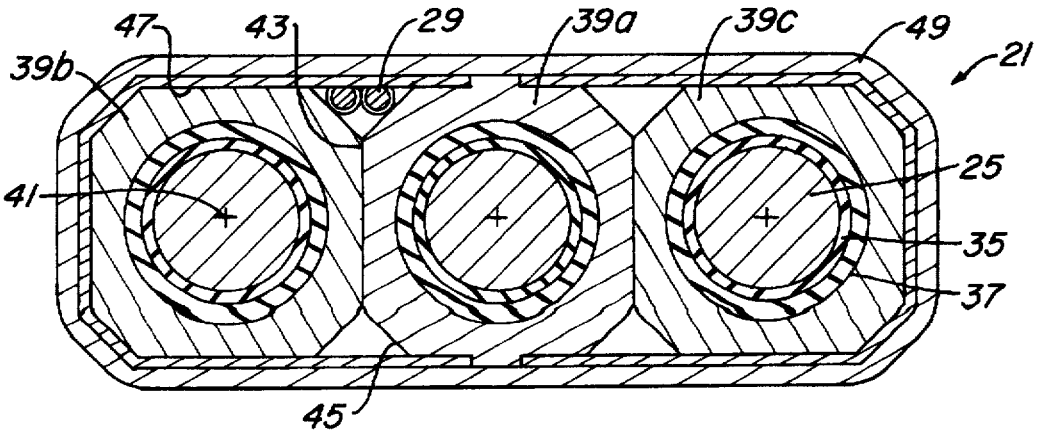
FIG. 2 is a an enlarged sectional view of the heater cable of FIG. 1.

Referring to FIG. 2, each conductor 25 is surrounded by a dielectric layer which is in a good high temperature electrical insulation. In the embodiment shown, the dielectric layer includes a polymer film or tape 35, which is preferably a polyamide marketed under the trademark Kapton. Alternately, the tape may be from a group consisting of chlorotrifluoroethylene (CTFE), fluorinated ethylene propylene (FEP), polyterrafluoroethylene (PTFE), or polyvinylidine fluoride (PVDF) or combinations thereof. Tape 35 is approximately 0.0015 inch in thickness, and after wrapping provides a layer of about 0.006 inch thickness.

The dielectric layer also has a polymer extrusion 37 which is extruded over tape 35. Extrusion 37 is also a good high temperature electrical insulator and is preferably an FEP marketed under the name Teflon.

Extrusion layer 37 is preferably about 0.010 inch in thickness. The thermal conductivities of tape 35 and extrusion 37 are poor, however being thin, do not significantly impede the transfer of heat from conductors 25. For the preferred materials, the thermal conductivity of tape 35 is 0.155 watts per meter, degree kelvin, while the thermal conductivity of extrusion 37 is 0.195 watts per meter, degree kelvin.

A protective metal sheath 39 is extruded over extrusion 37 in physical contact with outer dielectric layer 37. Protective sheath 39 is preferably of a material which is a good thermal conductor yet provides protection against damage to the electrical insulation layers 35, 37. Preferably, sheath 39 is of a lead or lead alloy, such as lead and copper. The thickness of lead sheath 39 is substantially greater than the thickness of the combined electrical insulation layers 35, 37. In the preferred embodiment, the thickness of lead sheath 39 is about 0.020 to 0.060 inch, preferably 0.050 inch. The range of the combined thickness for the two layers 35, 37 is about 0.010 inch to 0.025 inch. The thermal conductivity of lead is about 34 watts per meter, degree kelvin. Other metals that may be suitable for sheath 39 include steel and its alloys or aluminum and its alloys.

Heater cable 21 in the preferred embodiment is of a flat type. That is, the insulated conductors 25 are spaced side-by-side with their centerlines 41 located in a single plane. It is desired to facilitate heat conduction through lead sheaths 39. To enhance the heat conduction, the lead sheaths 39 are in physical contact with each other. Preferably lead sheaths 39 have a generally rectangular configuration, having four flat sides 43 with beveled corners 45. The flat sides 43 adjacent to each other are abutted in physical contact. The lead sheath 39*a* on the middle conductor 25 has oppositely facing flat sides 43 that abut one flat side 43 of each sheath 39*b*, 39*c* on the lateral sides.

In the embodiment shown, U-shaped liners 47 are employed around lead sheaths 39 to resist deformation due to the wrapping of an armor 49. Liners 47 are shown to be long U-shaped strips of a conductive metal, such as steel, which is harder than the lead alloy material of lead sheaths 39. Liners 47 extend around the sides, tops, and bottoms of the two lateral lead sheaths 39*b*, 39*c* and over a portion of the middle lead sheath 39*a*. Alternately, liners 47 may comprise a wrap of thin metal tape (not shown). Also, liners 47 may not always be required.

An outer armor 49 is wrapped around the subassembly comprising liners 47, lead sheaths 39, and sensing cable 29. Armor 49 is a metal tape, preferably steel, that is wrapped as in conventional electric power cable for electrical submersible pumps. Armor 49 is a good heat conductor, which is facilitated by metal-to-metal contact with sheaths 39 through retainers 47.

In operation, three-phase power will be supplied to the three conductors 25. Although conductors 25 are low in resistance, heat is generated within conductors 25 because of high current flow. The heat passes through the thin dielectric layer 35, 37 into the lead sheaths 39. The heat transmits readily through the lead sheaths 39 and out the armor 49 to tubing 15. The heat is transmitted to tubing 15 to maintain a desired minimum temperature in tubing 15.

A transducer (not shown) located on the lower end of sensor wire 29 senses the temperature of tubing 15 and applies a signal to temperature controller 31. Temperature controller 31 adjusts the current supplied by power supply 27 depending upon the desired temperature. Well fluid flowing through tubing 15 is heated from the tubing. The well fluid may be flowing as a result of an electrical submersible pump (not shown) installed on tubing 15, another type of artificial lift, or it may be flowing due to internal formation pressure.

A substantial improvement of the present invention over existing technology is that it operates at very low voltage and high current. This results from the use of low resistance materials such as copper as the heating element. The low resistance allows high current flow at low voltage, resulting in two advantages. First, low voltage decreases electrical stress on the insulation which increases the useful life of the cable. Secondly, the cable can be made in very long lengths of 10,000 ft. or more without having to apply high voltage at the power source.

Another advantage is that because the heat is generated by current through the conductors, the rate of heat generation is predictable along the cable throughout its length. Furthermore, if more heat is desired in any particular section of the installation, the diameter of the conductors can be reduced in this area to create more heat without adversely affecting the heat dissipation over the rest of the cable.

Temperature sensing devices within or attached to the cable can be used to monitor well conditions along the production tubing and/or to control the temperature of the cable by automatically adjusting the current supplied to the cable to achieve a preset desired temperature.

Lastly, because in the preferred embodiment the heater cable is a balanced three-phase system, the voltage at the end of the cable farthest from the power source where all three conductors are electrically joined together is at or near zero potential voltage with respect to earth. This provides easy access to attach other instruments which can use the heater cable as a transmission line to carry additional data about well conditions to the surface.

While the invention has been shown in only one of its forms, it should be apparent to those skilled in the art that it is not so limited but susceptible to various changes without departing from the scope of the invention. For example, rather than using three-phase power and three conductors for the heater cable, direct current power and two conductors could be employed.

We claim:

1. An electrical heater cable for heating a string of tubing located within a well, comprising:

a plurality of heater wires, each heater wire having a conductor of metal having high electrical conductivity, an electrical insulation layer surrounding the conductor, and a metal sheath surrounding the insulation layer, wherein the insulation layer comprises a polymer extrusion and has a thickness which is substantially no greater than 0.025 inch;

the heater wires being located adjacent to each other with their metal sheaths contacting each other, defining a subassembly;

an outer armor of metal tape wrapped around the subassembly with the sheaths in metal-to-metal contact with the outer armor; and wherein a lower end of each of the conductors may be connected together and current supplied to an upper end of the conductors to generate heat which transmits through the metal sheaths and the armor to the tubing.

2. The heater cable according to claim 1, wherein each of the insulation layers has a thickness smaller than the thickness of each of the metal sheaths.

3. The heater cable according to claim 1, wherein the insulation layer surrounding each of the conductors has a thickness which is at least 0.010 inch.

4. The heater cable according to claim 1, wherein each of the insulation layers comprises a tape wrapped around the conductor, with the polymer extrusion being over the tape.

5. The heater cable according to claim 1, wherein each of the metal sheaths has at least one flattened portion which is in flush contact with the flattened portion of an adjacent one of the metal sheaths.

6. In a well having a string of production tubing, an improved assembly for supplying heat to the tubing, comprising in combination:

a plurality of heater wires, each of the heater wires having a conductor, a dielectric layer surrounding the conductor, and a metal sheath surrounding the dielectric layer, the heater wires being positioned adjacent to each other with each of the metal sheaths being in physical contact with one other;

an outer armor of metal tape wrapped around the heater wires and in metal-to-metal contact with the metal sheaths, defining a heater cable;

the heater cable extending into the well and being secured to the production tubing, with a lower end of the heater cable having the conductors directly connected together and electrically isolated from the metal sheaths and the armor; and wherein the conductors are adapted to be connected to a power source for supplying electrical current to the heater wires, with the current flowing through the conductors causing heat to be generated by the conductors which passes through the dielectric layers, metal sheaths and armor to the tubing.

7. The well according to claim 6, wherein the dielectric layer surrounding each of the conductors comprises a polymer extrusion.

8. The well according to claim 6, wherein the dielectric layer for each of the heater wires comprises a polymer extrusion and wherein the dielectric layer has a thickness which is substantially no greater than 0.025 inch.

9. The well according to claim 6, further comprising:

an insulated thermocouple wire located next to the heater wires and surrounded by the outer armor.

10. The well according to claim 6, wherein the dielectric layer of each of the heater wires comprises a polymer tape wrapped around the conductor and a polymer extrusion over the polymer tape.

11. The well according to claim 6, wherein each of the sheaths has at least one flattened portion which is in flush contact with the flattened portion of an adjacent one of the heater wires.

12. The well according to claim 6, wherein:

the heater wires are wrapped with the armor in a side-by-side configuration, defining a middle heater wire and two lateral heater wires; and the sheath of the middle heater wire has flattened portions on opposite sides, and each of the sheaths of the lateral heater wires has a flattened portion in physical contact with one of the flattened portions of the sheath of the middle heater wire.

13. The well according to claim 6, wherein the dielectric layer of each of the heater wires has a thickness in the range from 0.010 to 0.025 inch.

14. The well according to claim 6, further comprising a metal liner located between the sheaths and the armor for protecting the sheaths during wrapping of the armor.

15. In a well having a string of production tubing, an improved assembly for supplying heat to the tubing, comprising in combination:

a plurality of heater wires, each heater wire having a copper conductor, a polymeric electrical insulation layer surrounding the conductor, and a lead sheath substantially of lead surrounding the insulation layer;

the insulation layer of each of the heater wires having a thickness that is substantially no greater than 0.025 inch;

the heater wires being assembled together in a subassembly with each of the sheaths in flush contact with an adjacent one of the sheaths;

an outer armor of steel tape wrapped around the subassembly in metal-to-metal contact with the sheaths, defining a heater cable;

the heater cable extending into the well and being secured to the tubing;

a power source for supplying electrical current to an upper end of each of the conductors, each of the conductors having a lower end directly connected together and electrically isolated from the sheaths and the armor, so that current supplied from the current flowing through the conductors causes heat to be generated by the conductors which passes through the insulation layers, lead sheaths and armor to the tubing.

16. The well according to claim 15, wherein the insulation layer of each of the heater wires has a thickness which is at least 0.010.

17. The heater cable according to claim 15, further comprising:

an insulated thermocouple wire located next to the heater wires and surrounded by the armor.

18. The well according to claim 15, wherein the insulation layer of each of the heater wires comprises a polymer tape wrapped around the conductor and a polymer extrusion over the polymer tape.

19. The well according to claim 15, further comprising:

a metal liner extending at least partially around the subassembly between the lead sheaths and the armor for protecting the lead sheaths during wrapping by the armor.

20. A method of heating a string of production tubing for a well, comprising:

providing a plurality of heater wires, each heater wire having a conductor, a dielectric layer surrounding the conductor, and a metal sheath surrounding the dielectric layer;

wrapping an outer armor of metal tape around the heater wires, with each of the sheaths being in physical contact with one other, defining a heater cable;

connecting the conductors of a lower end of the heater cable directly together;

securing the heater cable to the production tubing and lowering the production tubing and heater cable into the well; and supplying electrical current to upper ends of the heater wires, causing heat to be generated by the conductors, which passes through the dielectric layers, sheaths and armor to the production tubing.

* * * * *